US005577673A

United States Patent [19]

McMurphy et al.

[11] Patent Number: 5,577,673

[45] Date of Patent: Nov. 26, 1996

[54] DEODORIZED GARBAGE DISPOSAL SYSTEM

[75] Inventors: David L. McMurphy, Pensacola, Fla.; J. Bradley Donaghey, Mobile; Mark B. Reed, Spanish Fort, both of Ala.

[73] Assignee: Kitchen Fresh, Inc., Spanish Fort, Ala.

[21] Appl. No.: 435,160

[22] Filed: May 5, 1995

[51] Int. Cl.[6] ..... B02C 18/42

[52] U.S. Cl. ..... 241/33; 241/38; 241/46.013

[58] Field of Search ..... 241/46.013, 46.014, 241/33, 38

[56] References Cited

U.S. PATENT DOCUMENTS

| | | | |
|---|---|---|---|
| 3,510,069 | 5/1970 | Hannum . | |
| 3,831,514 | 8/1974 | Jernstrom | 100/70 |
| 3,926,379 | 12/1975 | Dryden et al. | 241/69 |
| 4,373,676 | 2/1983 | Sherman, Jr. | 241/36 |
| 4,516,281 | 5/1985 | MacPherson et al. | 4/319 |
| 4,837,455 | 6/1989 | Sleator | 307/38 |
| 4,852,813 | 8/1989 | Brackett | 241/30 |
| 4,910,808 | 3/1990 | Roth | 4/222 |
| 5,123,600 | 6/1992 | Takenaka | 241/46.013 |
| 5,127,587 | 7/1992 | Johnson | 241/46.013 |
| 5,129,590 | 7/1992 | Shinya | 241/46.013 |
| 5,174,042 | 12/1992 | Tomizawa et al. | 34/1 V |
| 5,249,749 | 10/1993 | Krebsbach | 241/46.016 |
| 5,308,000 | 5/1994 | Riley | 241/33 |
| 5,310,096 | 5/1994 | Rogers et al. | 222/402.13 |

*Primary Examiner*—John M. Husar

[57] ABSTRACT

A deodorizer apparatus for an electric grinder type garbage disposal system automatically injects a spray of deodorizer from a conventional spray can into the grinder chamber after the grinder motor is turned off, which is the optimum time for deodorizing. One type of actuator mechanism uses a shaft supported cam to depress the valve on the spray can. The cam is driven against a rest stop by a spring, and the spring is tensioned by a motor device operated in parallel with the grinder motor when the disposer is active. Another actuator mechanism uses a solenoid operated by logic circuits sensing the state of the grinder motor.

13 Claims, 3 Drawing Sheets

FIG. 2a
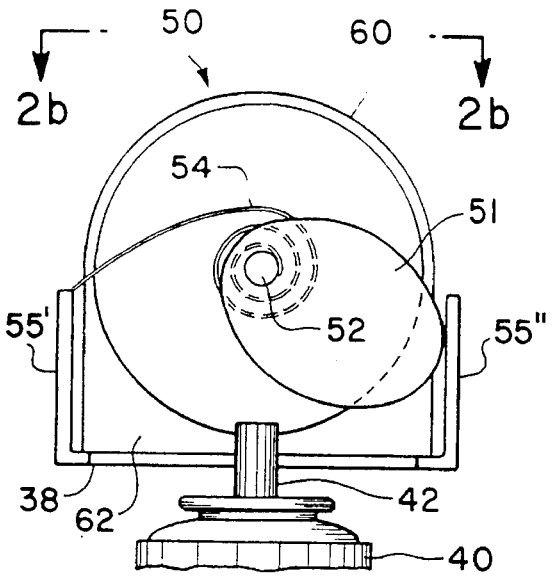
FIG. 3a
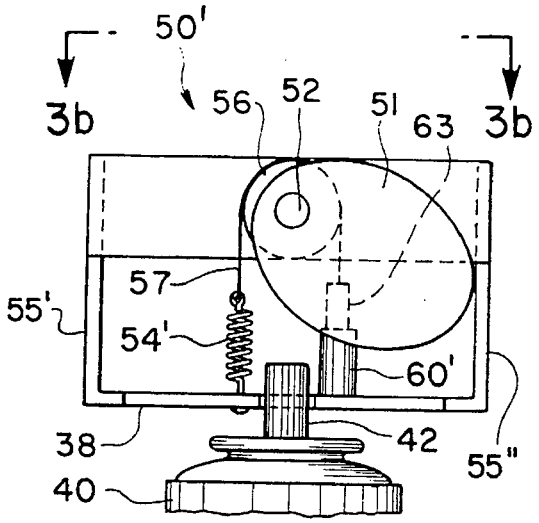
FIG. 2b
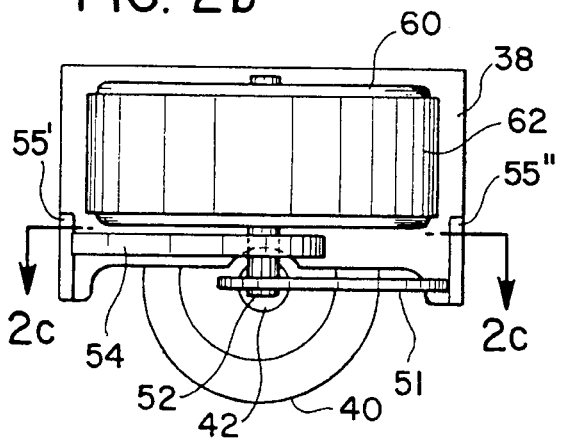
FIG. 3b
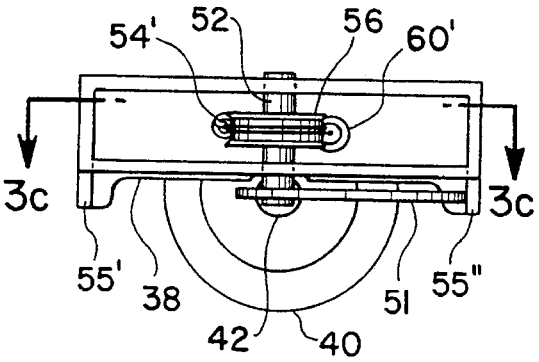
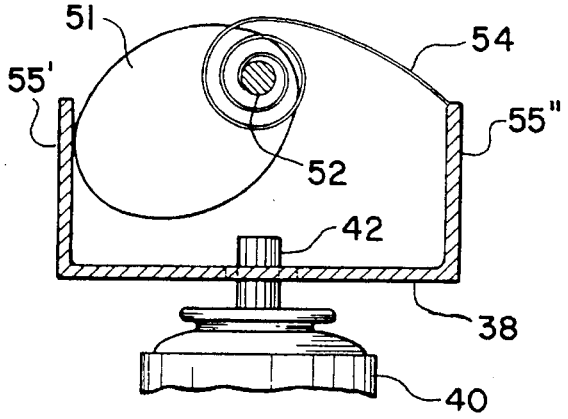
FIG. 2c
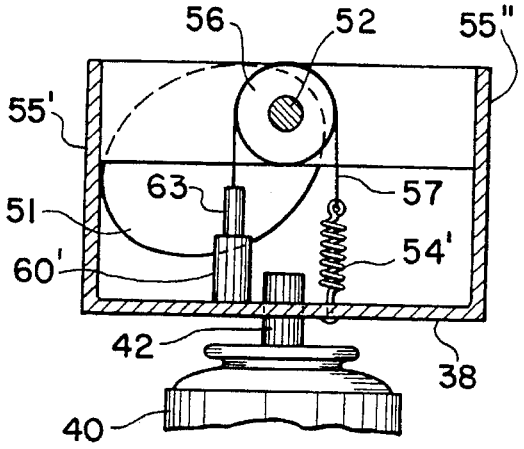
FIG. 3c

DEODORIZED GARBAGE DISPOSAL SYSTEM

BACKGROUND OF THE INVENTION

1. Field of the Invention

The present invention relates in general to garbage disposers, and more specifically to apparatus for eliminating odors from sink-mounted, electric grinder-type garbage disposers in homes.

2. Description of Related Art

Today, most new homes come equipped with a sink-mounted garbage disposer, which provides a convenient and sanitary way to dispose of food scraps via the sewer systems. Such a garbage disposer contains a motor driven grinder for kitchen waste. Cold water is continuously flushed through the grinder chamber during operation, partly to flush away the ground up waste, and partly to cool and lubricate the grinder mechanism. The water flush is usually manually controlled, but U.S. Pat. No. 3,510,069 to D. E. Hannum describes a device for automatically opening and closing a cold water tap for flushing a garbage disposer when the grinder motor is turned on and off.

In spite of the water flush, a garbage disposal unit, however, is a potential source of odors from decaying organic material remaining in the grinder after a disposal cycle. Several methods and devices for eliminating such odor problems have been proposed. An obvious remedy is to spray a disinfecting and/or deodorizing liquid from a spray can into the feed opening of the disposer. U.S. Pat. No. 5,310,096 to Rogers et al. describes an adapter for application of disinfectant foam from a spray can into the feed opening of a garbage disposer. Manual spray methods require that an operator remembers to perform a deodorant spray, and he or she must also locate a spray can, with or without a feed opening adapter, whenever disinfection or deodorizing is desired.

U.S. Pat. No. 4,910,808 to Roth describes a deodorizer dispenser using a standard spray can mounted upside down over an opening in the top of the sink next to the garbage disposer. The outlet of the spray can is connected via a tube through an opening in the side of the grinder chamber. Means are provided for manually depressing the spray can valve when deodorizing is desired. The deodorizer is thus always conveniently available, but the disposer operator must still remember to use it. The deodorizer assembly also takes up space on the sink, and it is rather cumbersome to replace the spray can.

U.S. Pat. No. 4,852,813 to Brackett describes an automatic method for treating a garbage disposer unit. This method is based on sponge like bodies impregnated with disinfectants or the like being fitted inside the grinding chamber. When the grinder is operating, the bodies are thrown against the walls of the chamber, so the sponge material is compressed to release disinfectants or other impregnation material. The Brackett method releases deodorants into the grinder chamber during the entire grinding/flushing operation, so lots of deodorizer material is consumed, but no deodorant is released after the grinder is shut off, which is when a deodorizing spray is needed most and will do the most good. The sponge like bodies take up space in the grinder chamber, and they are difficult to replace, so they will be left in the grinder until they are worn out, and there is no indication when it is time to add fresh deodorizer bodies.

SUMMARY OF THE INVENTION

It is a primary object of the present invention to provide automatic means for deodorizing a garbage disposal unit after the disposer has been shut off.

It is a further object of the present invention to provide a device for automatically deodorizing a garbage disposal unit after the disposer has been shut off, using a standard spray can as a replaceable source of disinfectant or deodorizer spray.

These and other objects of the present invention are accomplished by a garbage disposer operated by an electric on/off switch, which comprise; a deodorizer reservoir with an output port connected to a grinder chamber in the garbage disposer, a valve for controlling a flow of deodorizer through the output port, and automatic means for opening the valve briefly after the on/off switch is switched from on to off.

Additional objects and advantages of the invention will be set forth in part in the description which follows, and, in part, will be obvious from the description, or may be learned by practice of the invention. The objects and advantages of the invention may be realized and obtained by means of the instrumentalities and combinations particularly pointed out in the appended claims.

BRIEF DESCRIPTION OF THE DRAWINGS

The accompanying drawings, which are incorporated in and constitute a part of the specification, illustrate embodiments of the invention and, together with the description, serve to explain the principles of the invention.

FIGS. 2*a*–2*c* are different views of an actuator mechanism for a deodorized garbage disposal system according to a preferred embodiment of the invention.

FIGS. 3*a*–3*c* are different views of an alternative actuator mechanism for a deodorized garbage disposal system according to a preferred embodiment of the invention.

DETAILED DESCRIPTION OF A PREFERRED EMBODIMENT

Figure 1:
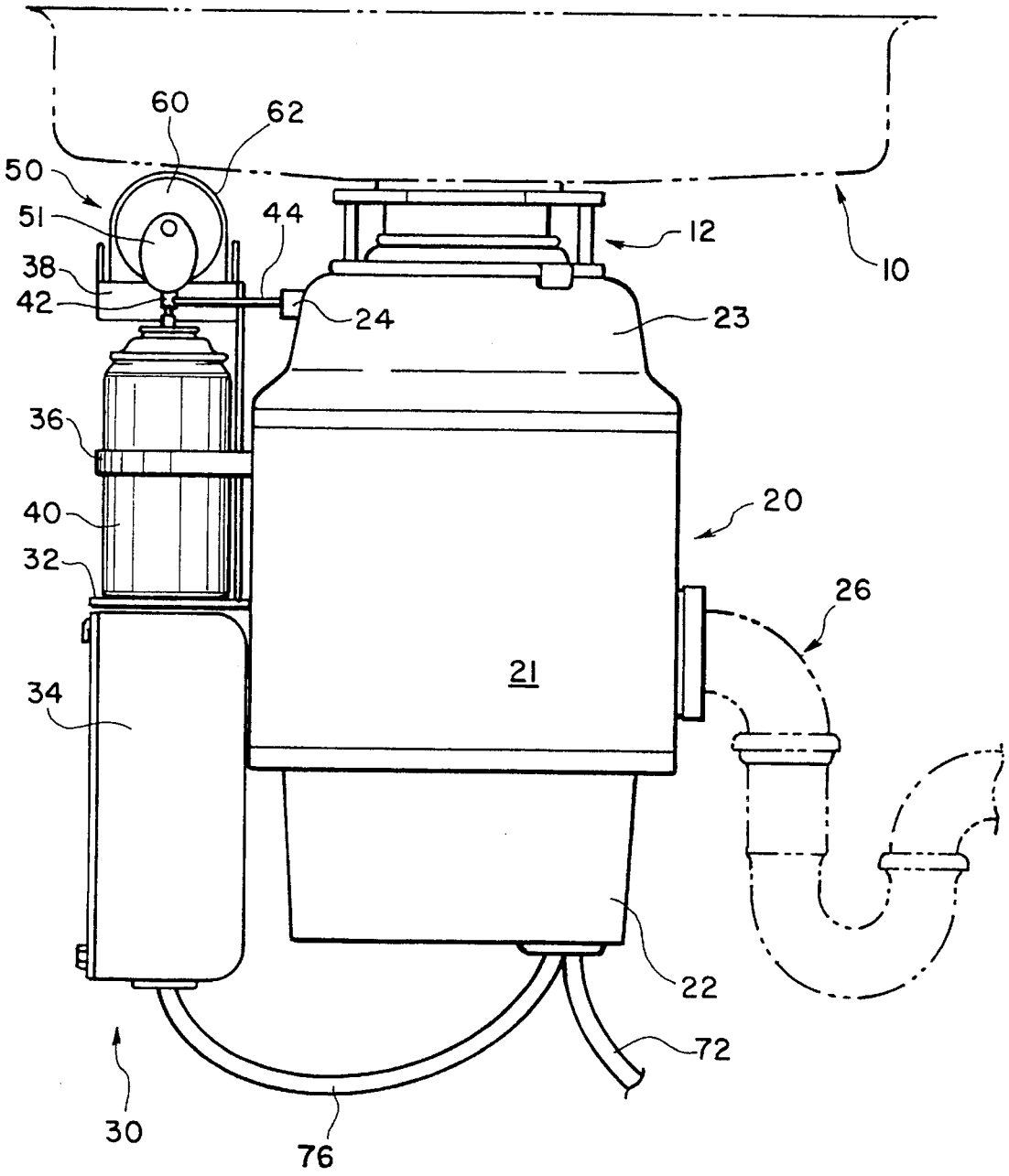
FIG. 1 is a front view of a deodorized garbage disposal system according a preferred embodiment of the invention.

FIG. 1 is a front view of a garbage disposer 20 mounted under a sink 10 with mounting hardware 12. The garbage disposer 20 comprises a motor 21 with a connection box 22 and a neck 23 containing a grinder chamber. The grinder chamber contains grinding discs driven by the motor 21 for grinding up waste material fed into the grinding chamber from the sink 10. Water is always flushed through the grinding chamber when the grinder is operating, partly to flush out the waste, and partly to lubricate and cool the grinding discs. A waste outlet pipe 26 with a water trap is arranged to transfer the waste slush to a sewer line.

An automatic deodorizer unit 30 according to a preferred embodiment of the invention is mounted on the left side of the garbage disposer 20 by means of a bracket 32. An electric connection box 34 is mounted below the bracket 32. A conventional spray can 40 with deodorizer fluid under gas pressure is mounted on the bracket 32 and held in place by a clamp 36. The spray can 40 is a conventional spray can with a top mounted valve 42 with a spray opening on the side, arranged to release a spray when the valve 40 is depressed toward the body of the can 40. The spray opening in the valve 42 is connected via a tube 44 to a fitting 24 arranged in the neck 23 of the garbage disposer 20, so a spray of deodorant will be released into the grinding chamber inside the neck 23 whenever the valve 42 is depressed. An actuator mechanism 50 for the valve 42 on the spray can 40 is mounted on a top shelf 38 on the mounting bracket 32.

Details of the actuator mechanism 50 are illustrated in FIGS. *2a–2c*, which are, respectively, a front view, a top view, and a partial rear view of the actuator mechanism 50 depicted in FIG. 1.

Figure 4:
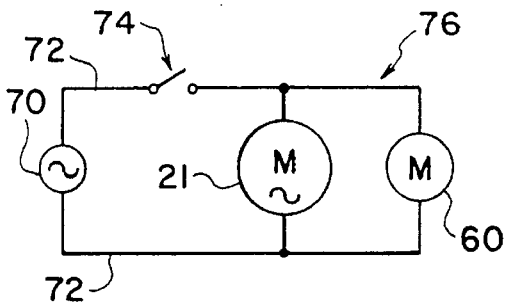
FIG. 4 is an electrical diagram for a deodorized garbage disposal system with an actuator mechanism as shown in FIGS. 2*a*–2*c*.

FIG. 4 is an electrical diagram for the garbage disposer 20 with deodorizer 30 and actuator mechanism 50. The grinder motor 21 is connected to household power 70 via a cable 72 and an on/off switch 74. An actuator motor 60 is connected in parallel with the grinder motor 21, so both motors will always be powered on and off at the same time.

The actuator mechanism 50 contains a cam 51 mounted on a shaft 52 and rotatable between two end positions defined by stops 55' and 55". When the actuator mechanism 50 is at rest, a clock spring 54 forces the cam 51 against one stop 55", as shown in FIGS. *2a* and *2c*. The cam 51 in this position does not touch the valve 42 on the spray can.

An electric actuator motor 60 with mounting bracket 62 is coupled to the cam shaft 52, or the motor shaft may serve as the cam shaft 52. The motor 60 is coupled electrically in parallel to the grinder motor 21, as shown in FIG. 4, so the motor 60 will exert torque on the cam shaft 52 as soon as the garbage disposer 20 is operating. This will cause the cam 51 to move clockwise in FIG. *2a* towards stop 55' against the torque exerted by the clock spring 54. Halfway between stops 55' and 55" the cam 51 will be positioned as shown in FIG. 1, and the valve 42 on the spray can 40 will be depressed, but when stop 55' is reached, the cam 51 will again be removed from the valve 42. A brief spray of deodorizer is, accordingly, injected automatically into the grinder chamber 23 shortly after the garbage disposer 20 is turned on. This eliminates risk of odors when the water flush accompanying start of the disposer 20 softens dried out waste inside the grinding chamber 23. After this initial deodorizer spray, the cam 51 will remain butting against stop 55' as long as the grinder motor 21 is running, and the valve 42 will be closed.

When the garbage disposer 20 is turned off by opening the on/off switch 74 (FIG. 4), power to the actuator motor 60 is also disconnected, so the actuator motor 60 will no longer exert any torque on the cam shaft 52. The clock spring 54 will then force the cam 51 back towards stop 55". On its way from stop 55' to 55", the cam 51 will briefly depress the valve 42 on the spray can 40 so a brief spray of deodorizer will be injected into the grinder chamber 23. This spray will happen automatically after the grinder is stopped, so deodorizer will always be injected into an empty grinder chamber, so it will not immediately be flushed out.

The basic requirements on the actuator motor 60 are that it can exert sufficient torque to move the cam 51 against the torque from the clock spring 54, and that it can remain stalled against stop 55' as long as the garbage disposer is on without overheating. Motor devices that fulfill these requirements are well known in the art, and are commercially available. The actuator motor 60 may be a DC motor with a rectifier instead of an AC motor as indicated in FIG. 4, and a gear motor may be used instead of a direct drive motor 60 to increase torque and slow the movement of the cam 51. In either case, the electrical diagram of FIG. 4 will be basically unchanged, and the function of the actuator mechanism will remain as described above.

An important feature of the automatic deodorizer apparatus 30 described above, is that a spray of deodorizer is made after the shut-off of the garbage disposer, i.e. when it will be most effective. This is achieved by the action of the spring 54, which forces the cam 51 back toward its rest position against stop 55". The function of the actuator motor 60 is only to tension the spring 54 before it is relied on to drive the cam 51.

Figure 5:
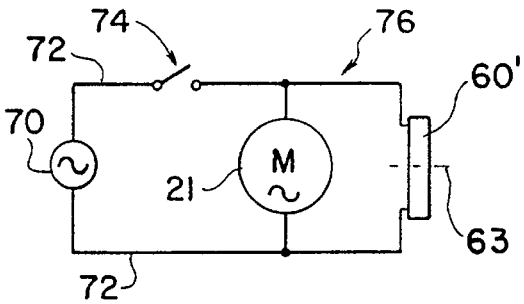
FIG. 5 is an electrical diagram for a deodorized garbage disposal system with an actuator mechanism as shown in FIGS. 3*a*–3*c*.

An alternative actuator mechanism 50' is shown in FIGS. *3a–3c*, which correspond to FIGS. *2a–2c* described above, and the electrical diagram shown in FIG. 5. In FIGS. *3a–3c*, the cam 51 on a shaft 52 is unchanged, but the motor 60 is replaced by a solenoid 60' with a plunger 63, and the clock spring 54 is replaced by a helical spring 54'. The linear movements of the plunger 63 and the helical spring 54' are converted to rotary motion of the shaft 52 by means of a wire 57 wrapped over a drum 56 on the shaft 52, as shown. The solenoid 60' is connected directly in parallel with the grinder motor 21, so the plunger 63 will retract into the solenoid coil when the disposer is turned on, thereby tensioning the helical spring 54' so the spring is ready to pull the cam 51 back over the valve 42 when the disposer is next turned off, exactly as described above with reference to FIGS. *2a–2c* and 4. A brief spray of deodorant into the grinding chamber will be made after the disposer is turned on even by this deodorizer actuator mechanism 50'.

An AC operated solenoid 60' will ordinarily not overheat when operating continuously powered. A solenoid 60' also has a fixed end position for the plunger 63, so the stop 55' for the cam 51 may be superfluous.

Those skilled in the art of mechanical design will understand that the speed of rotation of the cam 51 can be slowed by magnetic braking or air dampers if it is desirable to delay the sprays of deodorant or to increase the duration of the sprays in either of the actuator mechanisms 50 and 50' described above.

Figure 6:
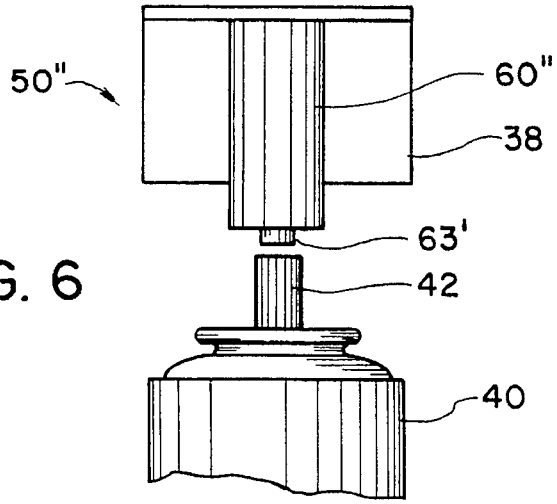
FIG. 6 is a front view of a third alternative actuator mechanism for a deodorized garbage disposal system according to a preferred embodiment of the invention.
Figure 7:
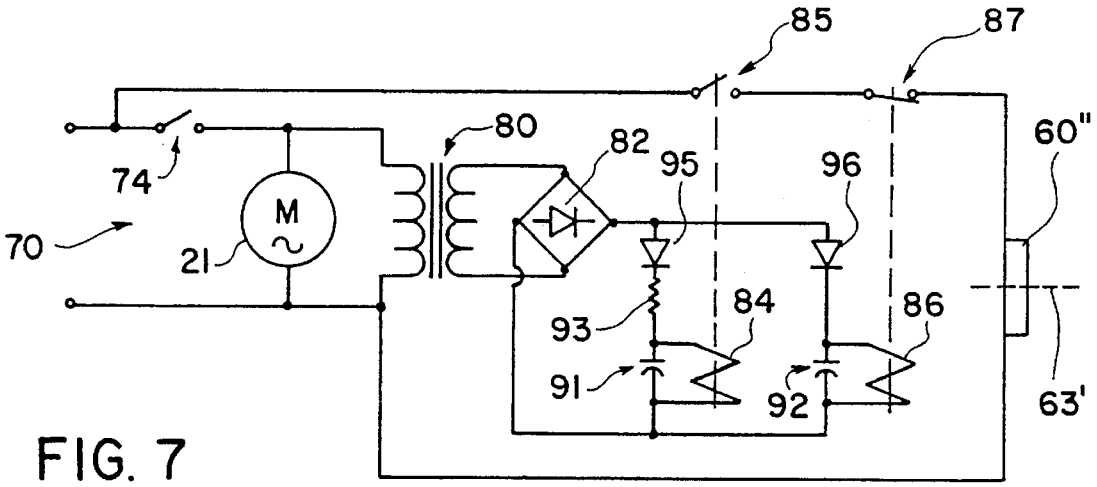
FIG. 7 is an electrical diagram for a deodorized garbage disposal system with an actuator mechanism as shown in FIG. 6.

A third alternative actuator mechanism 50" for the valve 42 according to the preferred embodiment of the invention is illustrated in FIGS. 6 and 7. FIG. 6 shows an actuator mechanism 50" utilizing a solenoid 60" mounted on an extension of the mounting bracket 38. The solenoid 60" has a spring loaded plunger 63' located directly above the top of the valve 42 on the spray can 40, which is mounted as shown in FIG. 1. The valve 42 will be depressed to produce a spray of deodorant into the grinder chamber 23 when the solenoid 60" is energized so the plunger 63' is extended.

FIG. 7 shows an electrical diagram for a simple relay logic circuit for controlling the solenoid 60". The solenoid is powered from the house power 70 via two series connected relay contacts 85 and 87, one normally open and the other normally closed. Relay contacts 85 and 87 are operated by separate relay coils 84 and 86, which both are energized in parallel with the grinder motor 21 via a transformer 80, a rectifier bridge 82, and separate diodes 95 and 96. Both relay coils 84 and 86 are shunted by capacitors 91 and 92 respectively, and a small resistor 93 is connected between the diode 95 and relay coil 84. Capacitor 91 is larger than capacitor 92.

When the switch 74 is off, both relay coils 84 and 86 are de-energized, so contacts 85 and 87 are in the positions shown in FIG. 7, and the solenoid 60" is deenergized. When the switch 74 is turned on, the grinder motor 21 starts, and the transformer 80 with rectifier bridge 82 are energized. Relay coil 86 is immediately fully energized, so contact 87 opens. Shortly thereafter, relay coil 84 will be energized, so contact 85 closes. The delay in closing of relay 84 is caused by a time constant introduced by resistor 93 and capacitor 91. The solenoid 60" remains de-energized, because at least one of contacts 85, 87 is always open.

When the switch 74 is opened, the grinder motor 21 stops, and transformer 80 with rectifier bridge 82 is de-energized. Both relay coils 84, 86 remain energized by the electrical charge stored in capacitors 91 and 92, so the solenoid 60" initially remains deenergized, but both capacitors start to discharge, while the diodes 95 and 96 serve to isolate the two capacitors 91 and 92 so they can discharge independently. After a short delay, determined by the size of the smaller capacitor 92, the voltage on relay coil 86 will become insufficient, so relay contact 87 will close, while the other relay coil 84 will remain energized by the larger capacitor 91. This causes solenoid 60" to be connected directly to house power 70, and the plunger 63' in the solenoid 60" will depress the valve 42 so a spray of deodorant is injected from the spray can 40 into the grinder chamber 23 of the garbage disposer 20 via the tube 44 and the fitting 24.

Shortly thereafter, the voltage on the larger capacitor 91 drops below the excitation limit for coil 84, and contact 85 opens. This disconnects the solenoid 60" from the house power 70, so the spring loaded plunger 63' retracts, the valve 42 is released, and the deodorant spray stops. Both relays 84, 86 are now back to their original rest states, so the process can be repeated when the switch 72 is turned on again.

The time delay between shutting off the garbage disposer 20 and the initiation of deodorant spray is determined by the holding time for relay 86 provided by capacitor 92, while the duration of the deodorant spray itself is determined independently by the difference in holding times for relays 84 and 86 provided by capacitors 91 and 92. By changing of capacitors 91 and 92, it is thus possible to vary the initial delay and the spray duration within wide limits.

It should be noted that the actuator mechanism 50 described above with reference to FIGS. 6 and 7 provides deodorant spray only after shut off of the grinder motor 21, which is the optimum time for deodorizing a garbage disposer 20. No deodorant is wasted earlier in the cycle.

The actuating mechanism 50" illustrated in FIGS. 6 and 7 can easily be modified to use solid state logic instead of relay logic, without any change in the principles of operation. The logic can also be expanded to include one or more sprays of deodorant while the garbage disposal is in operation, if this is desirable. Such modifications can be made by one skilled in the art in view of the above description for the invention, so no further details are required for the purpose of the invention.

Deodorizer apparatus for a garbage disposer and deodorized garbage disposers according to the embodiments of the invention offer the main advantage over the prior art that a deodorizer spray is injected automatically into the grinder chamber a short time after the garbage disposer motor has been shut off. At that time, the grinder chamber will be substantially empty, so the deodorizing effect will be optimal, and no deodorizer is flushed down the drain from a full grinder chamber. Embodiments of the invention can use a conventional spray can as source of deodorant, as described in the examples above, but it will be obvious that the invention can also be used with any other source of deodorant.

Thus, it is intended that the present invention cove all modifications and variations in deodorized garbage disposal or a deodorizing apparatus for a garbage disposal in accordance with the invention within the scope of the appended claims and their equivalents and without limitation to the different environments.

What is claimed is:

1. A water flushed garbage disposer operated by an electric on/off switch, comprising:

(a) a deodorizer reservoir having an output port connected to a grinder chamber in said garbage disposer;

(b) a valve for controlling a flow of deodorizer through said output port; and (c) automatic means for opening said valve briefly after said on/off switch is switched from on to off.

2. A water flushed garbage disposer according to claim 1, wherein said deodorizer reservoir is a commercial spray can with deodorizer under gas pressure and a valve which releases a spray of deodorizer liquid when mechanically depressed.

3. A water flushed garbage disposer according to claim 2, wherein said automatic means comprises a movable cam arranged to operate said valve, a mechanical spring urging said cam towards a rest position, and motor means arranged to move said cam away from said rest position for tensioning of said spring when said on/off switch is turned on, said motor means allowing said spring to force said cam towards said rest position for operating said valve briefly to apply a deodorant spray when said on/off switch is turned off.

4. A water flushed garbage disposer according to claim 1, wherein said automatic means comprises an electric solenoid with a plunger arranged to operate said valve, and means controlled by said on/off switch for energizing said solenoid for a brief period after said on/off switch is switched from on to off.

5. A deodorizing apparatus for a water flushed garbage disposer operated by an electric on/off switch, comprising:

(a) a reservoir of a liquid disinfectant or deodorizing agent having an output port;

(b) means for connecting said output port to a grinding chamber in said disposer;

(c) a valve for controlling a flow of said liquid agent through said output port; and (d) means controlled by said on/off switch for opening said valve briefly after said on/off switch is switched from on to off.

6. A deodorizing apparatus for a water flushed garbage disposer according to claim 5, wherein said reservoir is a commercial spray can with the liquid disinfectant or deodorizing agent under gas pressure and a valve which releases a spray of the liquid agent when mechanically depressed.

7. A deodorizing apparatus for a water flushed garbage disposer according to claim 6, wherein said automatic means comprises a movable cam arranged to operate said valve, a mechanical spring urging said cam towards a rest position, and motor means arranged to move said cam away from said rest position for tensioning of said spring when said on/off switch is turned on, said motor means allowing said spring to force said cam towards said rest position for operating said valve briefly to apply the spray of liquid agent when said on/off switch is turned off.

8. A deodorizing apparatus for a water flushed garbage disposer according to claim 6, wherein said automatic means comprises an electric solenoid with a plunger arranged to operate said valve, and means controlled by said on/off switch for energizing said solenoid for a brief period after said on/off switch is switched from on to off.

9. A garbage disposer operated by an electric on/off switch, comprising:

(a) a commercial spray can with deodorizer under gas pressure having an output port connected to a grinder chamber in said garbage disposer;

(b) a valve on said spray can which is arranged to release a spray of deodorizer liquid through said output port when depressed; and (c) automatic means for depressing said valve briefly after said on/off switch is switched from on to off.

10. A garbage disposer according to claim 9, wherein said automatic means comprises a movable cam arranged to operate said valve, a mechanical spring urging said cam towards a rest position, and motor means arranged to move said cam away from said rest position for tensioning of said spring when said on/off switch is turned on, said motor means allowing said spring to force said cam towards said rest position for operating said valve briefly to apply a deodorant spray when said on/off switch is turned off.

11. A deodorizing apparatus for a garbage disposer operated by an electric on/off switch, comprising:

(a) a commercial spray can containing a liquid disinfectant or deodorizing agent under gas pressure and having an output port;

(b) means for connecting said output port to a grinding chamber in said disposer;

(c) valve means for controlling a flow of said liquid agent through said output port, said valve means including a valve on said spray can which releases a spray of the liquid agent when mechanically depressed; and (d) means controlled by said on/off switch for opening said valve briefly after said on/off switch is switched from on to off.

12. A deodorizing apparatus for a garbage disposer according to claim 11, wherein said automatic means comprises a movable cam arranged to operate said valve, a mechanical spring urging said cam towards a rest position, and motor means arranged to move said cam away from said rest position for tensioning of said spring when said on/off switch is turned on, said motor means allowing said spring to force said cam towards said rest position for operating said valve briefly to apply the spray of liquid agent when said on/off switch is turned off.

13. A deodorizing apparatus for a garbage disposer according to claim 11, wherein said automatic means comprises an electric solenoid with a plunger arranged to operate said valve, and means controlled by said on/off switch for energizing said solenoid for a brief period after said on/off switch is switched from on to off.

* * * * *